US010010138B1

(12) United States Patent
Nicholson

(10) Patent No.: US 10,010,138 B1
(45) Date of Patent: Jul. 3, 2018

(54) SHOE FASTENING ASSEMBLY AND METHODS

(71) Applicant: David K. Nicholson, Jacksonville, FL (US)

(72) Inventor: David K. Nicholson, Jacksonville, FL (US)

( * ) Notice: Subject to any disclaimer, the term of this patent is extended or adjusted under 35 U.S.C. 154(b) by 347 days.

(21) Appl. No.: 14/289,113

(22) Filed: May 28, 2014

(51) Int. Cl.

| | |
|---|---|
| ***A43C 7/00*** | (2006.01) |
| ***A44B 15/00*** | (2006.01) |
| ***A44C 5/18*** | (2006.01) |
| ***A43C 11/22*** | (2006.01) |
| ***A43C 11/00*** | (2006.01) |
| ***A43C 5/00*** | (2006.01) |
| ***A43C 7/08*** | (2006.01) |

(52) U.S. Cl.
CPC ..... *A43C 11/22* (2013.01); *A43C 5/00* (2013.01); *A43C 7/005* (2013.01); *A43C 7/08* (2013.01); *A43C 11/00* (2013.01)

(58) Field of Classification Search
CPC .. A43C 5/00; A43C 7/005; A43C 7/08; A43C 11/00; A43C 11/22
USPC ..... 24/712.1, 712.4, 128, 116 A; 36/50.1
See application file for complete search history.

(56) References Cited

U.S. PATENT DOCUMENTS 294,228 A * 2/1884 Hanlon ..... F16G 11/00 24/128
1,806,162 A * 5/1931 Hahn ..... A43C 7/04 24/129 B
1,934,455 A * 11/1933 Staude ..... A43C 1/02 24/102 E
1,966,135 A * 7/1934 Reh ..... A43C 11/22 24/102 E
2,266,083 A * 12/1941 Rzepa ..... A43C 11/22 24/267
2,370,358 A * 2/1945 Koch ..... D06F 53/00 24/129 R
2,392,648 A * 1/1946 Cushman ..... B65D 63/14 24/18
2,689,991 A * 9/1954 Fedankiw ..... A43C 11/22 24/370
3,193,950 A * 7/1965 Liou ..... A43C 11/004 24/713.9
3,296,669 A * 1/1967 Elder, Jr. ..... A43C 7/00 24/129 R (Continued)

OTHER PUBLICATIONS

Product Overview from website www.storesavings.com for the Cushe Pad It Out Lace Shoes for Women (dated Feb. 24, 2014).

*Primary Examiner* — Clinton T Ostrup
*Assistant Examiner* — Cameron A Carter
(74) *Attorney, Agent, or Firm* — Durham, Jones & Pinegar, P.C., Intellectual Property Law Group

(57) ABSTRACT

Shoe fastening assembly for a split vamp shoe having at least a pair of opposed eyelets on either side of the split and includes an elongated rigid member with an arcuate curved lower surface and a pair of spaced apertures at each end of the member and a throat extending outwardly from each aperture, and a continuous elongated elastomeric band located in each aperture and passing beneath the member and lying on the tongue of the shoe. The band cross-section at rest is larger than each aperture and when stretched readily passes through each throat. A plurality of members and bands are provided for additional pairs of eyelets on the shoe and methods of fastening a shoe are herein included.

19 Claims, 4 Drawing Sheets

(56) References Cited

U.S. PATENT DOCUMENTS 3,509,581 A * 5/1970 Lewis ..... A41F 11/02 2/240
3,701,572 A * 10/1972 Velasquez ..... A43C 1/02 24/712.4
4,485,529 A * 12/1984 Blum ..... A43C 7/005 24/128
4,553,293 A * 11/1985 Blum ..... A43B 1/0081 24/306
4,571,854 A * 2/1986 Edens ..... A43B 1/0081 24/128
4,790,048 A * 12/1988 Arnt ..... A43C 7/00 24/712.1
5,008,983 A * 4/1991 Heins ..... F16G 11/046 24/129 A
5,029,371 A * 7/1991 Rosenblood ..... A43B 3/0078 24/115 G
5,065,482 A * 11/1991 Lofy ..... A43B 1/0072 24/712.1
5,737,811 A * 4/1998 Rashid ..... A43C 1/02 24/575.1
D402,191 S * 12/1998 Feder ..... D8/395
5,845,422 A * 12/1998 Valteau, III ..... A43B 3/0078 36/136
5,894,640 A * 4/1999 Dewey ..... A43C 11/00 24/306
5,979,028 A * 11/1999 Hicks ..... A43B 3/0078 24/130
6,701,589 B1 * 3/2004 Kliewer ..... A43C 11/22 24/712
7,073,282 B2 * 7/2006 Savagian ..... G09F 3/0295 24/129 B
7,150,757 B2 * 12/2006 Fallin ..... A61B 17/0487 24/129 R
D587,988 S * 3/2009 Johansson ..... D8/356
7,856,698 B2 * 12/2010 Hays ..... B65D 63/109 24/129 A
2003/0041478 A1 * 3/2003 Liu ..... A43C 1/00 36/50.1
2006/0080814 A1 * 4/2006 Kim ..... A43C 7/00 24/712.1
2010/0192337 A1 * 8/2010 LaPlante ..... A43B 3/0078 24/712
2010/0269373 A1 * 10/2010 Pirkle ..... A43C 7/00 36/136
2010/0275757 A1 * 11/2010 Hallet ..... A63C 11/025 84/318
2014/0137432 A1 * 5/2014 Eldem ..... A43B 1/0081 36/50.1

* cited by examiner

SHOE FASTENING ASSEMBLY AND METHODS

FIELD OF THE INVENTION

This invention generally relates to fastening assemblies for shoes and particularly sports related shoes. Also, the fastening assemblies are intended to replace the common shoelaces used for centuries to lace up the split upper sides of shoes.

BACKGROUND OF THE INVENTION

There are many different inventions and uses in this country related to fastening of shoes worn by people. One such invention is disclosed in U.S. Pat. No. 6,701 589, in which a double ended hook is attached to an elongated elastomeric fastener passed through a pair of generally aligned eyelets respectively on a shoe split upper, with the respective looped ends attached to an end of the hook with the hook lying on the tongue of the shoe.

Other patents and prior uses include U.S. Pat. Nos. 1,966,135; 5,737,811, and Cushe Pad It Out Lace Shoes, illustrated at www.storesavings.com and submitted herewith.

There are many problems of the prior art which are believed to be overcome by the herein disclosed and claimed invention. The stretchable elastic members may be selected from graduated lengths by the wearer of the shoe; the rigid elements generally spanning between opposed pairs of eyelets have an arcuate curved bottom face across the bulbous upper top of a foot of a wearer; the rigid members are elongated and have opposite end portions containing spaced apertures with a reduced neck slot communicating with the aperture so that the elastic member is stretched to reduce its diameter to pass through the neck and retracts to fill up and snaps into the aperture so that the rigid member is gripped thereby and held in place with respect to the elastic member while permitting minor lateral shifting of the rigid member to center the rigid member between the respective pair of opposed eyelets; the forces on the rigid member exerted by the elastic is more evenly distributed by the dual engagement at each end of the rigid member by the elastic member which enhances its useful life, as well as many other important advantages over the known prior art.

BRIEF SUMMARY OF THE INVENTION

Replaceable shoe fastening assemblies for a pair of shoes wherein each assembly has at least a pair of opposed horizontal disposed eyelets on respective sides of a split vamp or upper side of the shoe and a tongue between a foot of a wearer and the eyelets designed to receive a shoe lace for closure of the vamp about the wearer's foot. Each assembly in accord with one aspect of this invention has an elongated substantially rigid planar member spanning generally the space of a split vamp of a shoe and the member has opposite and portions with each end portion having a flattened horn cleat lying in the plane of said rigid member. A continuous elongated elastomeric band with two loop shaped ends, one of which is placed over the two horns of one of said horn cleats adjacent one side of a vamp, with the remainder of said band being passed through one adjacent eyelet on the one side then passing beneath the rigid member and through an adjacent eyelet on another side of a vamp and then is placed over the two horns of horn cleat on the other end of the rigid member adjacent to the another side of a vamp with the rigid member being located between the sides of a split vamp and a central portion of the elastic band lying beneath the rigid member and engaged with a tongue of the shoe.

In accord with other aspects of this invention, each said horn cleat preferably incorporates a spaced pair of apertures in each of said end portions with each said aperture having an inlet neck communicating with each said aperture and said neck being narrower than said aperture. The continuous elongated elastomeric band has a cross-sectional dimension substantially equal to a cross-sectional dimension of each of said apertures and said loop shaped end passes into a said pair of inlet necks and out of said necks into said pair of apertures adjacent one side of a vamp with no portion of said band being retained within said necks when said loop engages a said cleat. In addition, each aperture has an inlet neck communicating outwardly of the rigid member, the inlet neck being dimensioned to permit entrance of the band when sufficiently stretched to reduce the cross-sectional dimension thereof temporarily during passage of the band through the neck and released thereafter in the aperture, expands to substantially fill the aperture. Furthermore, the band when in unstretched condition has a cross-sectional dimension greater than each of the apertures.

Further aspects include at least another rigid member identical to the rigid member and another band identical to the band, the another rigid member and another band being connected together identically to the rigid member and the band and connected to another horizontal pair of spaced eyelets spaced from the pair of spaced eyelets. The another band may be shorter than or longer than or the same size and length of the band so that the tension supplied by the other band is selectable by the wearer of the shoes. Of course, the assembly is designed for spaced plurality of pairs of eyelets that are present on the shoes and thus a plurality of other spaced rigid members identical to the rigid member, a plurality of other bands identical to the band and having different lengths, other rigid members and respective other bands being connected together identically to the rigid member and said band and respectively connected to other horizontal pairs of spaced eyelets spaced from each other and spaced from the pair of spaced eyelets. Preferably the inlet neck is between, 0.70-1.50 mm, the cross sectional dimension of the aperture is between 1.50-2.50 mm, and the cross-sectional dimension of the band is between 1.40-3.50 mm. Also, the band is formed of a latex core wrapped in a woven polyester or nylon sheath that is stretchable as the core is stretched. The elastomeric band is at least stretchable to three times the at rest length and has an at-rest cross-sectional dimension greater than each of the cross-sectional dimensions of the apertures so that the elastomeric band does not move freely through the apertures.

BRIEF DESCRIPTION OF THE DRAWINGS

The features and advantages of the present disclosure will become more apparent from the detailed description set forth below when taken in conjunction with the drawings in which like reference numbers indicate identical or functionally similar elements.

DETAILED DESCRIPTION OF THE INVENTION

Figure 1:
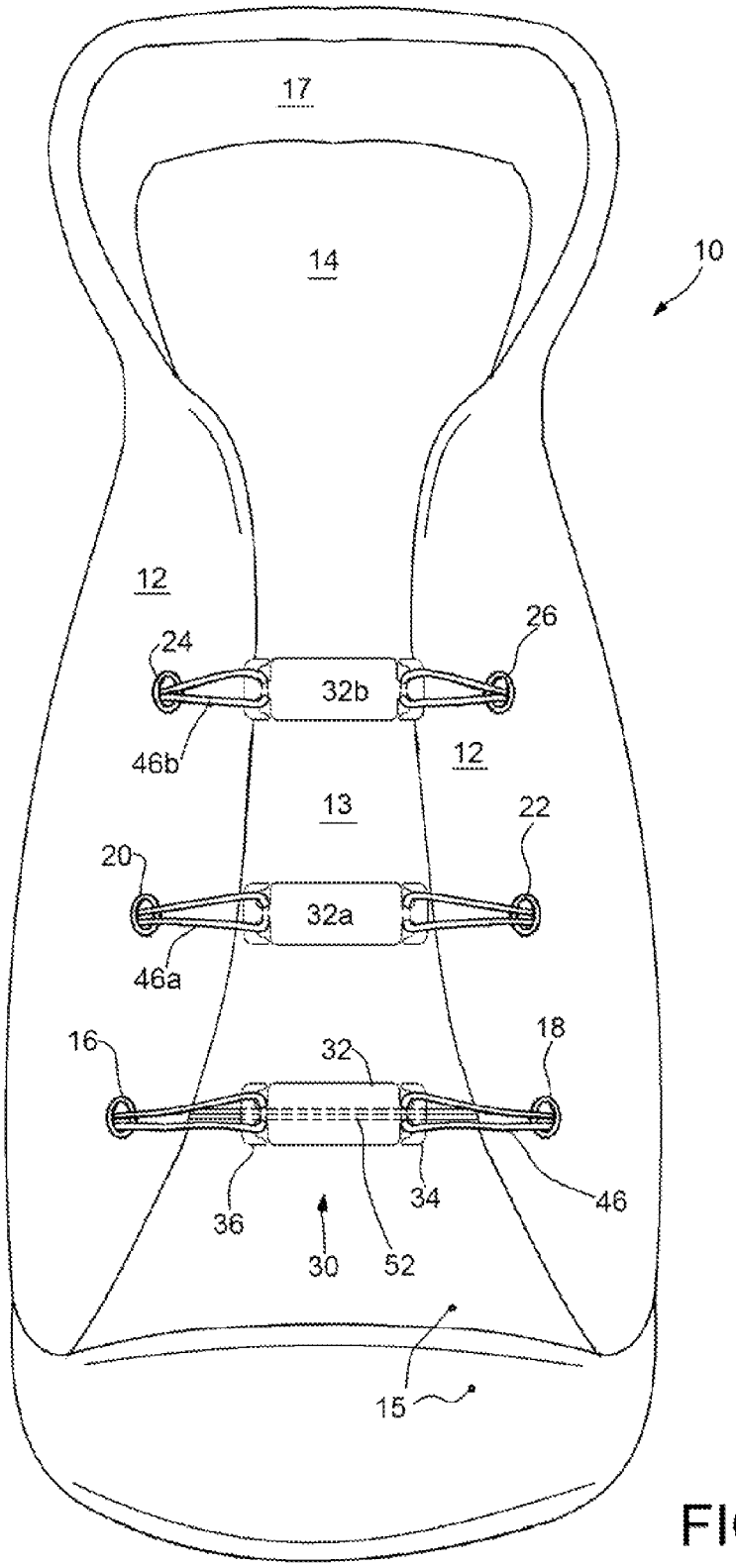
FIG. 1 is an oxford shoe with three pairs of apposed eyelets fastened by 3 sets of the fastening assemblies in accordance with this invention.

This invention relates to improvements in replacing the usual laces passing through a plurality of spaced pairs of horizontal disposed eyelets of a shoe (an oxford type shoe) converted into a fitted shoe without usual laces for a wearer that can accommodates a foot of a wearer by sliding the foot into the shoe. In accord with the invention such a shoe is depicted on FIG. 1 and identified by numeral 10 and includes a split vamp or upper side 12 with a tongue 14 underlying the upper side 12. The tongue 14 extends generally from the toe box 15 and terminates forwardly of the heel 17. The shoe fastening assembly is generally noted by numeral 30 and includes an elongated substantially rigid planar member 32 spanning generally the space 13 of a split vamp 12 of a shoe 10, the member 32 having opposite and portions 36, 34 comprising horned cleats lying in the plane of the rigid member 32 preferably incorporating a spaced pair of apertures 38 in each of the end/clear portions 36, 34 and each aperture 38 having an inlet neck 42 communicating therewith and each neck 42 being narrower than the aperture 38. Applicant intends for the purpose of this application that the definition of eyelet not only includes metal or plastic usual eyelets affixed to a hole in the leather, plastic, rubber, fabric and other materials used to construct shoes, but also includes the actual hole in such materials through which a shoe lace may extend as well as a loop of fabric of the shoe through which a lace may extend, such loops being on either side of the split vamp. Throughout this application eyelet and horizontally disposed eyelets, and spaced pair of eyelets are set forth and all such structures are contemplated to be covered and protected by this invention.

Figure 2:
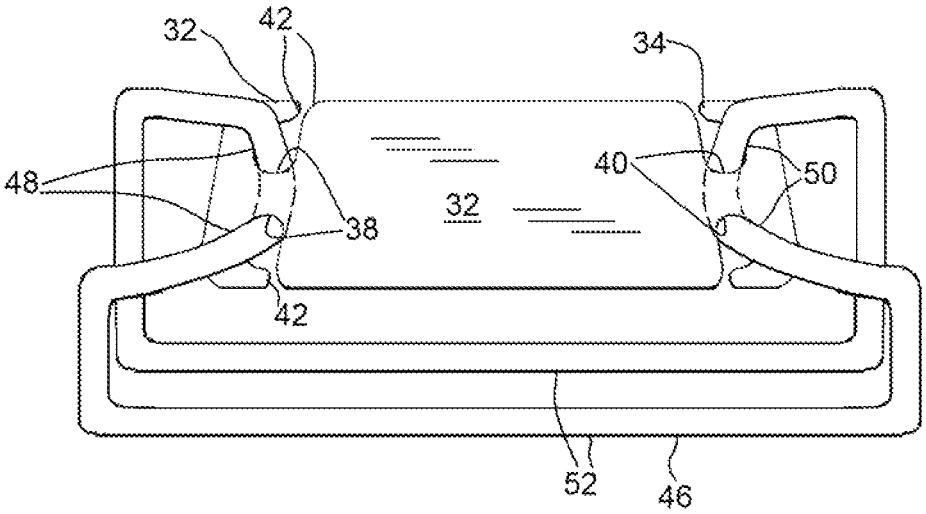
FIG. 2 is a perspective representation of one fastening assembly of FIG. 1.
Figure 3:
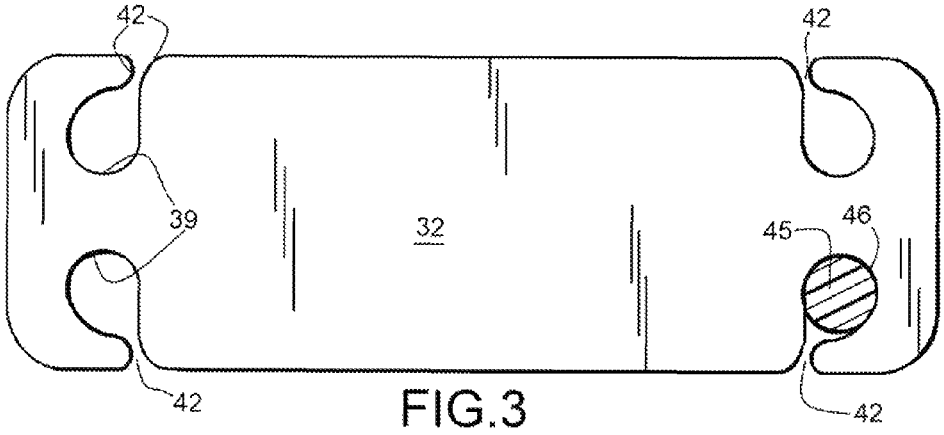
FIG. 3 is a top plan view of one of the rigid members shown in FIG. 1 and forming a first embodiment of this invention.
Figure 4:
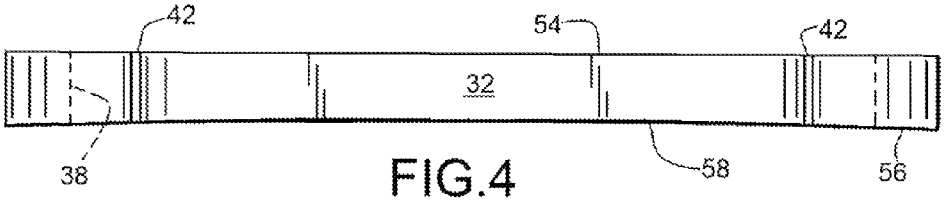
FIG. 4 is a side elevational view of FIG. 3.

A continuous elongated elastomeric band 46 has a cross-sectional dimension substantially equal to a cross-sectional dimension of each of the apertures, and the band 46 is attached to the rigid member 32 by passing through a pair of apertures 38 adjacent one side of a vamp 12, through one adjacent eyelet 16 on one side of the vamp 12, then the rigid member 32 and through an adjacent eyelet 18 on the other side of a vamp 12 and then passing through the other pair of apertures 40 on the rigid member 32 adjacent to the side of vamp 12 with the rigid member 32 lying between the two sides of the split vamp 12, and a central portion 52, of the elastic band 46 lying beneath the rigid member 32 and engaged with tongue 14 of the shoe, as more clearly illustrated in FIG. 2. Each inlet neck communicates with an aperture 38 and outwardly of the rigid member 32, and dimensioned to permit entrance of the band 46 when sufficiently stretched to reduce the cross-sectional dimension thereof temporarily during passage of the band 46 through the neck 42 and released thereafter when moved into the aperture 38. The band 46 preferably has, when in unstretched condition, a cross-sectional dimension greater than the cross-sectional dimension of each of the apertures 38.

Because most shoes have a plurality of horizontally spaced eyelets 16, 18; 20, 22; and 24, 26; that are spaced apart perpendicular or vertical to the horizontal direction, other rigid members identical to rigid member 32 are provided, as well as, bands 46 and 48 identical to other band 46. The other rigid members 32*a* and 32*b* and the other bands 46*a* and 46*b* are connected identically to the rigid member 32 connection by the band 46 and connected to respective pairs of spaced eyelets 20, 22 and 24, 26 spaced from the pair of spaced eyelets 16, 18. It is to be noted that the bands 46, 46*a* and 46*b* may be of the same length or may have shorter or longer lengths depending on the preference of the wearer, as well as the desired band tension preferred by the wearer.

Preferably the bands 46, 46*a* and 46*b* are each formed of a latex core wrapped in a woven polyester or nylon sheath that is also stretchable like the commonly used bungee cords, thus core and sheath both stretch with the sheath acting as a protective covering for the core. The rigid members 32, 32*a* and 32*b* are each a flattened member having a predetermined length disposable in the space between the split vamp 12 or upper sides of a shoe and those members each have a top surface 54 and a bottom surface 56 with the bottom surface 56 being arcuate 58 along its length to readily conform generally to a curved top of a foot of a wearer to enhance the comfort to a wearer of the shoe with the therein disclosed fastening assembly 30. The elastomeric bands 46, 46*a,* and 46*b* are each preferably at least stretchable to three times the at rest length and has a cross-sectional dimension greater than each of the cross sectional dimensions of the apertures 48, 50 so that the elastomeric bands do not move freely through the apertures 48, 50 when the elastic bands 46, 46*a,* and 46*b* are at rest.

Figure 5:
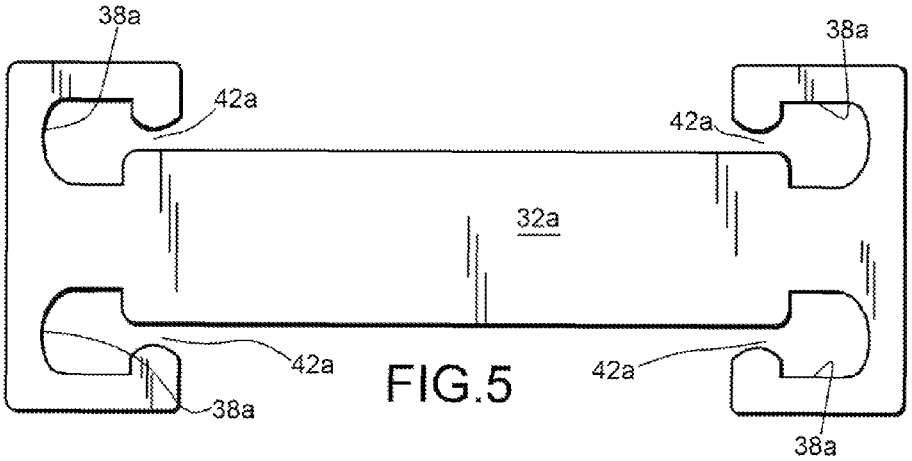
FIG. 5 is a top plan view of one of the rigid members in accord with a second embodiment of this invention.
Figure 6:
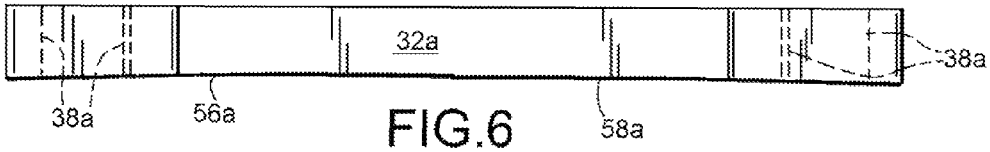
FIG. 6 is a side elevational view of FIG. 5.

Another substantially rigid member 32*a* is shown in FIGS. 5 and 6 and is very similar to member 32 shown in FIGS. 1-4 and includes substantially similar features namely apertures 38*a,* necks 32*a,* curvature 58*a* on the bottom surface 56*a*.

Figure 7:
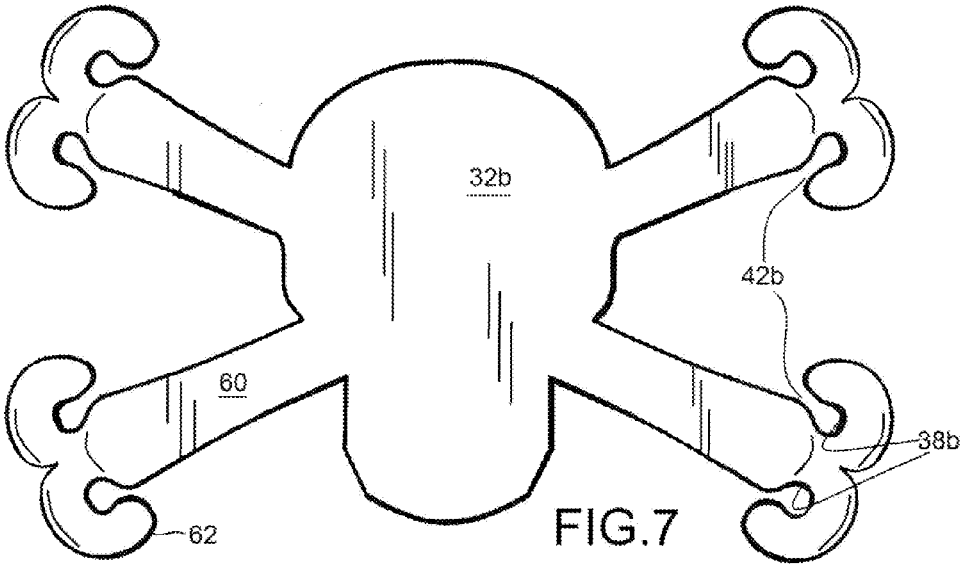
FIG. 7 is a top plan view of one of the rigid members n accord with a third embodiment of the invention.
Figure 8:
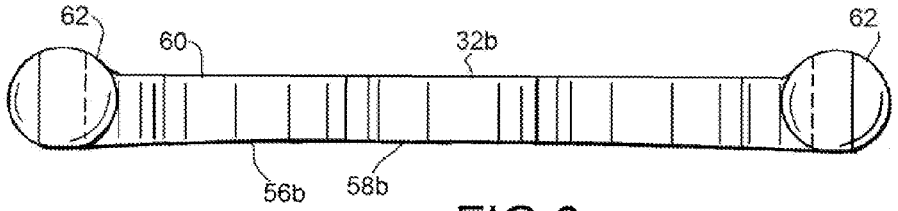
FIG. 8 is a side elevational view of one of the rigid members in accord with a third embodiment of this invention.

A further embodiment of a substantially rigid member 32*b* is shown in FIGS. 7 and 8 having a shape generally of a skull and cross-bones with each arm 60 having a spaced pair of apertures 38*b,* necks 32*b,* curvature 58*b* on the bottom surface 56*b*. Basically, each end 62 of arm 60 is bulbous and this member 32*b* provides the rigid member for adjacent pairs of horizontally spaced eyelets, for example, as seen in FIG. 1, connecting bands 46 and 46*a* which pass through eyelets 16, 18 and 20, 22. Of course if the depicted shoe 10 had four pairs of eyelets, only two of the rigid members 32*b* would be used on such a shoe.

Figure 9:
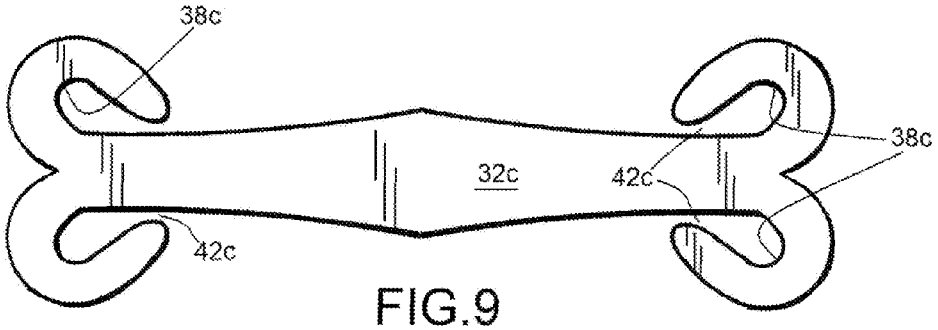
FIG. 9 is a top plan view of one of the rigid members in accord with a fourth embodiment of this invention.
Figure 10:
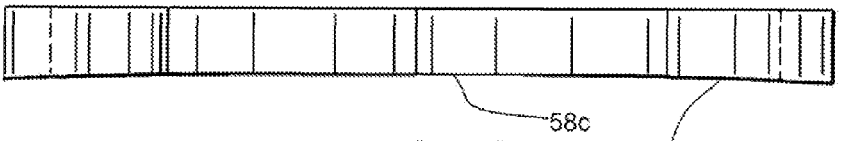
FIG. 10 is a side elevational view FIG. 9.

FIGS. 9 and 10 disclose another substantially rigid member 32*c* which has substantially similar features of apertures 38*c,* necks 42*c,* curvature 58*b* in the bottom surface 56*c*. Other shapes of the substantially rigid members will occur to those having ordinary skill in the art without departing from the spirit and scope of the herein disclosed and claimed invention.

In accord with this invention several methods of fastening a shoe are disclosed herein, the first being as follows:

a) placing a loop portion of a continuous elongated elastomeric band through an eyelet away from the tongue;

b) attaching the loop into a pair of spaced apertures in an end portion of an elongated rigid member;

c) placing another loop portion opposite the loop portion outwardly through the opposite horizontal disposed eyelet;
d) attaching the another loop portion into another pair of spaced apertures in an opposed end portion of the elongated rigid member; and
e) repeating steps a-d for each other spaced pairs of opposed horizontal disposed eyelets to fasten the shoe to a foot of a wearer.

Another method and procedure is disclosed by a user:
a) placing a loop portion of a continuous elongated elastomeric band through an eyelet toward the tongue and through the opposed eyelet leaving the mid-portion of the band spanning the split;
b) attaching the loop portion adjacent the opposed eyelet to a pair of spaced apertures in an end portion of an elongated rigid member generally spanning the split;
c) attaching another loop end portion of the band adjacent the eyelet and spaced from the opposed eyelet to a pair of spaced apertures in another end portion of the rigid member; and
d) repeating steps a-c for each other spaced pairs of opposed horizontally disposed eyelets to fasten the shoe to a foot of a wearer.

Each of the above methods may include the step of stretching the band to pass through a neck communicating with each aperture and releasing the band when disposed fully in each aperture, which would logically follow in understanding the basic methods disclosed and claimed herein.

Other methods of using this invention such as, for example, when loops are formed on the split vamp include passing a doubled up band through both opposed loops, passing an upper run of that band to opposed end apertures on the rigid member and another doubled up band having another upper run of another band connected to the other opposed end aperture on the rigid member and passing through another opposed loops of the shoe adjacent to the aforesaid opposed loops of the shoe, thus connecting two adjacent pair of loops with only one rigid member. By so doing, if the shoe has four pair of opposed loops only two rigid members may be used, and if there are five pairs, the upper loops can be connected by a single band and a rigid member.

Yet other methods of use are very possible by using the bands and rigid members according to this invention and all such methods are intended to be covered hereunder.

In view of the foregoing, it should be clear that numerous changes and variations can be made without exceeding the scope of the inventive concept outlined. Accordingly, it is to be understood that the embodiment(s) of the invention herein described is/are merely illustrative of the application of the principles of the invention. Reference herein to details of the illustrated embodiment(s) is not intended to limit the scope of the claims, which will recite those features regarded as essential to the invention.

I claim:

1. A system for fastening a shoe with at least one pair of eyelets on opposite sides of a split vamp of an upper of the shoe, the system comprising: an elongated member capable of spanning the split vamp of the upper of the shoe and of lying flat across the split vamp, the elongated member including a retaining element at each end thereof, each retaining element comprising a pair of spaced apart apertures and a corresponding pair of inlet necks, each inlet neck of the pair of inlet necks extending between an aperture of the pair of spaced apart apertures and an outer edge of the elongated member, a distance across each inlet neck being 0.7 mm to 1.5 mm and a distance across each aperture being 1.5 mm to 2.5 mm; an elastomeric band having a relaxed cross-sectional diameter of 1.4 mm to 3.5 mm, the elastomeric band capable of being retained by the retaining element and on the elongated member while the elastomeric band is in a relaxed state and while tension is applied to the elastomeric band, by introducing a first side of a first looped end of the elastomeric band into a first aperture of the pair of apertures of the retaining element and introducing a second side of the first looped end into a second aperture of the pair of apertures, with the first looped end extending over a portion of the top of the elongated member located and a remainder of the elastomeric band extending across a corresponding end of the elongated member from a location beneath the elongated member, through a second eyelet of the at least one pair of eyelets on a second side of the split vamp, with a second looped end of the elastomeric band being retained by the retaining element of the opposite end of the elongated member.

2. The system of claims 1, wherein the distance across the inlet neck is capable of receiving a portion of the elastomeric band when the elastomeric band is sufficiently stretched to reduce a cross-sectional diameter thereof temporarily during passage of the portion of the elastomeric band through the inlet neck and preventing passage of the portion of the elastomeric band through the inlet neck as tension on the portion of the elastomeric band is released.

3. The system of claim 2, wherein the relaxed cross-sectional diameter of the elastomeric band exceeds the diameter of the aperture.

4. The assembly of claim 1, further comprising:
at least another elongated member; and
at least another elastomeric band.

5. The system of claim 4, wherein the at least another elastomeric band has a length that differs from a length of the elastomeric band.

6. The system of claim 4, comprising a plurality of elongated members and a plurality of elastomeric bands with a plurality of different lengths.

7. The assembly of claim 1, wherein the elastomeric band comprises a closed loop.

8. The assembly of claim 1, wherein the elongated member is a flattened member having a predetermined length disposable across the split vamp of the upper of the shoe, a bottom surface of the elongated member being concavely arcuate along its length to generally conform to a curved top of a foot of a wearer.

9. The assembly of claim 1, wherein the elastomeric band is stretchable to at least three times its relaxed length and has a cross-sectional diameter that exceeds the diameter of the aperture so that the elastomeric band does not move freely through the aperture when the elastomeric band is in the relaxed state.

10. The assembly of claim 1, wherein the elastomeric band comprises a latex core wrapped in woven polyester or a nylon sheath that is stretchable as the latex core is stretched.

11. A method for fastening a shoe that has a plurality of spaced pairs of opposed eyelets on opposite sides of a split vamp of an upper of the shoe, with a tongue being located across an opening defined by the split vamp but below edges of the split vamp, the method comprising: securing a first looped end of an elastomeric band having a relaxed cross-sectional diameter of 1.4 mm to 3.5 mm to a first retaining element on a first end portion of an elongated member, including: positioning the first looped end over the first retaining element; applying tension to the first looped end and to opposed portions of the elastomeric band located adjacent to opposite sides of the first looped end while introducing the opposed portions of the elastomeric band into 0.7 mm to 1.5 mm inlet necks on opposite sides of the first end portion of the elongated member and into 1.5 mm to 2.5 mm apertures communicating with the inlet necks; and releasing the tension in the first looped end, a relaxed cross-sectional diameter of the elastomeric band exceeding a distance across each inlet neck, enabling each inlet neck to retain a portion of the elastomeric band in a corresponding aperture while the elastomeric band remains in a relaxed state; placing a second looped end of the elastomeric band through an eyelet of a shoe in a direction toward the tongue of the shoe; moving the second looped end of the elastomeric band across the tongue of the shoe; placing the second looped end of the elastomeric band through an opposite, corresponding eyelet from a location adjacent to the tongue of the shoe to a location outside the split vamp; securing the second looped end of the elastomeric band to a second retaining element on a second end portion of the elongated member, including: positioning the second looped end over the second retaining element; applying tension to the second looped and to opposed portions of the elastomeric band located adjacent to opposite sides of the second looped end while introducing the opposed portions of the elastomeric band into inlet necks on opposite sides of the second end portion of the elongated member and into apertures communicating with the inlet necks; and releasing the tension in the second looped end, a relaxed cross-sectional diameter of the elastomeric band exceeding a distance across each inlet neck, enabling each inlet neck to retain a portion of the elastomeric band in a corresponding aperture while the elastomeric band remains in a relaxed state; repeating placing the first looped end, securing the first looped end, placing the second looped end, and securing the second looped end with another elastomeric band and another elongated member in another pair of eyelets.

12. A method for fastening a shoe with a plurality of spaced pairs of eyelet, comprising: selecting an elongated member; selecting an elastomeric band having a relaxed cross-sectional diameter of 1.4 mm to 3.5 mm from a plurality of different sizes of elastomeric band to provide a desired amount of tension across a split vamp of an upper of a shoe when used with the elongated member; placing a loop portion of the elastomeric band through an eyelet adjacent to an edge of the split vamp, toward the tongue, across the tongue, and through a corresponding, opposed eyelet; attaching the loop portion to spaced apart 1.5 mm to 2.5 mm apertures in an end portion of the elongated member through 0.7 mm to 1.5 mm inlet necks; positioning the elongated member across the tongue; attaching another loop portion of the elastomeric band to spaced apertures in an opposite end portion of the elongated member; and repeating selecting the elongated member, selecting the elastomeric band, placing the loop portion, attaching the loop portion, positioning the elongated member, and attaching the another loop portion for another pair of eyelets adjacent to opposite edges of the split vamp, with another elongated member and another elastomeric band, size of the elastomeric band and the another elastomeric band differing from one another.

13. The method of claim 11, further comprising:

selecting the elastomeric band from a plurality of different sizes of elastomeric bands.

14. The method of claim 13, wherein selecting the elastomeric band comprises selecting a size of elastomeric band that will secure a portion of the shoe to an individual's foot with a desired amount of tension.

15. The method of claim 14, wherein selecting comprises selecting a combination of elastomeric bands of different sizes that will, in combination, provide the shoe with a desired fit on the individual's foot.

16. The method of claim 13, further comprising:

introducing an individuals' foot into the shoe, elastomeric bands and elongated members enabling the individual's foot to be introduced into the shoe without untying the shoe and enabling the shoe to remain on the individual's foot without tying the shoe.

17. The method of claim 12, wherein selecting the elongated member comprises selecting the elongated member from a plurality of different sizes and configurations of elongated members.

18. The method of claim 17, wherein selecting the elongated member comprises selecting the elongated member based on a distance across an opening defined by the split vamp.

19. The method of claim 12, wherein selecting the elastomeric band comprises selecting the elastomeric band based on at least one of a size and configuration of the elongated member, a distance between a pair of eyelets with which the elastomeric band is to be used, and a tension desired across a location of the shoe where the elastomeric band and the elongated member will be used.

* * * * *